US012690692B2

(12) United States Patent
Pettit et al.

(10) Patent No.: US 12,690,692 B2
(45) Date of Patent: Jul. 28, 2026

(54) TEXTURE MASKING OF A PATTERNED GEL LAYER OF A MATTRESS

(71) Applicant: Purple Innovation, LLC, Lehi, UT (US)

(72) Inventors: Janae Lois Pettit, Pleasant Grove, UT (US); James T. Grutta, Draper, UT (US); Russell B. Whatcott, Eagle Mountain, UT (US)

(73) Assignee: Purple Innovation, LLC, Lehi, UT (US)

( * ) Notice: Subject to any disclaimer, the term of this patent is extended or adjusted under 35 U.S.C. 154(b) by 211 days.

(21) Appl. No.: 18/421,524

(22) Filed: Jan. 24, 2024

(65) Prior Publication Data

US 2024/0245227 A1 Jul. 25, 2024

Related U.S. Application Data

(60) Provisional application No. 63/440,815, filed on Jan. 24, 2023.

(51) Int. Cl.
*A47C 27/08* (2006.01)
*A47C 27/14* (2006.01)

(52) U.S. Cl.
CPC ..... *A47C 27/085* (2013.01); *A47C 27/14* (2013.01)

(58) Field of Classification Search
CPC ..... A47C 27/085; A47C 27/14; A47C 27/148; A47C 27/15; A47C 27/124; A47C 27/05; A47C 27/088
USPC ..... 5/676
See application file for complete search history.

(56) References Cited

U.S. PATENT DOCUMENTS

| | | | | |
|---|---|---|---|---|
| 12,383,072 | B2 * | 8/2025 | Moon | A47C 31/006 |
| 2013/0043628 | A1 * | 2/2013 | Pearce | A47C 7/02 267/153 |
| 2014/0373282 | A1 * | 12/2014 | Mossbeck | A47C 27/05 267/142 |
| 2016/0157625 | A1 | 6/2016 | Schneider et al. | |
| 2016/0262561 | A1 * | 9/2016 | Pearce | B32B 3/266 |
| 2017/0254379 | A1 * | 9/2017 | Whatcott | A47C 27/00 |
| 2019/0029438 | A1 * | 1/2019 | Moon | A47C 31/006 |
| 2019/0150629 | A1 * | 5/2019 | Pearce | A47C 27/16 |
| 2019/0200570 | A1 * | 7/2019 | Abel | A01K 1/0353 |

(Continued)

OTHER PUBLICATIONS

USPTO acting as International Searching Authority, "Search Report and Written Opinion," International Application No. PCT/US2024/012774, Apr. 30, 2024.

*Primary Examiner* — Myles A Throop
(74) *Attorney, Agent, or Firm* — Foley & Lardner LLP

(57) ABSTRACT

A mattress cover masks, buffers, or dampens the feel of the texture of the upper surface of a patterned gel layer of an upper cushioning element of a mattress. The mattress cover includes an outer surface, a mask layer, an outer periphery, and an optional bottom. A configuration of the mask layer enables it to mask, buffer, or dampen the feel of the texture of the upper surface of the patterned gel layer without interfering with a compressibility of the upper cushioning element. The mask layer may include a patterned gel layer with a different pattern than that of the patterned gel layer of the upper cushioning element of the mattress. Methods of manufacturing and installing mattress covers that mask, buffer, or dampen the feel of a patterned gel layer of an upper cushioning element of a mattress are also disclosed.

21 Claims, 2 Drawing Sheets

(56) References Cited

U.S. PATENT DOCUMENTS

| | | | | |
|---|---|---|---|---|
| 2020/0390247 | A1* | 12/2020 | Taylor | B32B 3/08 |
| 2021/0076833 | A1 | 3/2021 | Alletto, Jr. | |
| 2022/0167753 | A1* | 6/2022 | Rasmussen | A47C 27/05 |
| 2022/0296003 | A1* | 9/2022 | Whatcott | A47C 27/15 |

* cited by examiner

TEXTURE MASKING OF A PATTERNED GEL LAYER OF A MATTRESS

CROSS-REFERENCE TO RELATED APPLICATION

A claim for priority to the Jan. 24, 2023 filing date of U.S. Provisional Patent Application No. 63/440,815, titled TEXTURE MASKING OF A PATTERNED GEL LAYER OF A MATTRESS ("the '815 Provisional Application") is hereby made pursuant to 35 U.S.C. § 119(e). The entire disclosure of the '815 Provisional Application is hereby incorporated herein.

TECHNICAL FIELD

This disclosure relates generally to mattresses with upper cushioning elements formed from elastomeric gels and including interconnected walls that define arrays of cells to define patterned gel layers. More specifically, this disclosure relates to mattresses with mattress covers that mask, buffer, or dampen the texture of the upper surfaces of the patterned gel layers for individuals as they rest or sit on sleep surfaces of the mattresses. This disclosure also relates to methods for masking, buffering, or dampening the texture of the upper surface of a mattress with a patterned gel layer formed from an elastomeric gel.

RELATED ART

A mattress with an upper cushioning element that includes one or more patterned gel layers provides a soft surface that conforms to the shape of an individual's body, deforming under features that create relatively high pressures over small areas while supporting features that create relatively low pressures over larger areas. Purple Innovation of Lehi, Utah manufactures a variety of these mattresses. The elastomeric gel mattresses that have been made by Purple include covers formed from stretchable fabrics positioned directly on the upper surface of the upper cushioning element of the mattress so individuals can experience the full cushioning and supportive effects of the patterned gel layer.

While patterned gel layers are very comfortable and highly supportive, some individuals can feel the texture of a patterned gel layer as they sit or lie on the mattress. The texture of the patterned gel layer is undesirable to some of these people.

SUMMARY

In various aspects, this disclosure relates to masking, buffering, or dampening, the texture of a patterned gel layer of a mattress or another cushion.

Embodiments of a mattress according to this disclosure include an internal mattress assembly and a mattress cover. The mattress cover is positioned over the internal mattress assembly. The mattress cover masks, buffers, or dampens the texture or feel of an upper surface of an upper cushioning element of the internal mattress assembly. The mattress cover may be permanently secured in place over the internal mattress assembly or it may be removable from the internal mattress assembly.

The internal mattress assembly may include an upper cushioning element, which is also referred to herein as a primary cushion, that comprises a plurality of interconnected walls defined from an elastomeric gel. The plurality of interconnected walls may define an array of cells. The interconnected walls and the array of cells may define a patterned gel layer.

The mattress cover may include a top panel and a periphery. The top panel may be located over an upper surface of the patterned gel layer of the upper cushioning element.

The top panel of the mattress cover may include an outer surface, a mask layer, and optionally, an inner layer. The outer surface may be formed from a fabric that forms an outer surface of the top, or a sleep surface, of the mattress. The fabric of the outer surface may be stretchable. A stretchability of the fabric may enable the upper cushioning element to deform without interfering with a compressibility of the upper cushioning element.

The mask layer of the top panel of the mattress cover may be located beneath the outer surface of the top panel of the mattress cover. The mask layer comprises a material that masks, buffers, or dampens a texture of the upper surface of the patterned gel layer of the upper cushioning element. An elasticity of the mask layer may enable it to mask, buffer, or dampen the texture of the upper surface of the patterned gel layer without interfering with a compressibility of the upper cushioning element.

The mask layer may have a thickness of about one quarter inch (about 6.35 mm) to about one inch (about 2.54 cm) (e.g., about one half inch (about 12.7 mm), etc.).

The mask layer may comprise a layer of a compressible, resilient foam, a stretchable batting, a patterned gel layer, a ventilating layer (e.g., a ventilating layer of the type described by U.S. Pat. No. 11,311,111, the entire disclosure of which is hereby incorporated herein, etc.), and/or the like. In embodiments where the mask layer comprises a patterned gel layer, the patterned gel layer may comprise an elastomeric gel defining a plurality of interconnected walls defining an array of cells. Cells of the array of cells may have shapes and/or dimensions that differ from shapes and/or dimensions of cells of the array of cells of the upper cushioning element of the mattress assembly. For example, a maximum dimension across a center of a cell of the array of cells of a mask layer that comprises a patterned gel layer may be smaller than a maximum dimension across a center of a cell of the array of cells of the upper cushioning element of the mattress assembly.

The mask layer may be secured in place beneath the outer surface. Without limitation, the mask layer may be sewn to (e.g., quilted with, etc.), adhered to, or bonded to the outer surface. In embodiments where the mask layer comprises a patterned gel layer, the elastomeric gel of the patterned gel layer may seep into, or wick into impregnate, a fabric of the outer surface.

The inner layer, if any, of the top panel of the mattress cover may be located beneath the mask layer of the top panel of the mattress cover. In addition to or as an alternative to securing the mask layer to the outer surface, the mask layer may be secured to the inner layer. As a few examples, the mask layer may be sewn to, adhered to, or bonded to the inner layer. In embodiments where the mask layer comprises a patterned gel layer, the elastomeric gel of the patterned gel layer may seep into, or wick into or impregnate, a fabric of the inner layer. The inner layer may hold the mask layer in place beneath the outer surface of the top panel. A material from which the inner layer is formed may have a stretchability that enables the upper cushioning element to deform without interfering with a compressibility of the upper cushioning element.

The top panel of the mattress cover may be positioned over the upper surface of the upper cushioning element in such a way that the mask layer of the top panel masks, buffers, or dampens the texture or feel of the upper surface of the upper cushioning element. The top panel may contact the upper surface of the upper cushioning element. In embodiments where the top panel of the mattress cover lacks an inner layer, the mask layer may be positioned directly on and, thus, contact the upper surface of the upper cushioning element. An overall construction of the top panel of the mattress cover may enable the upper cushioning element to deform without interfering with a compressibility of the upper cushioning element.

The periphery of the mattress cover extends downwardly from edges of the top panel. A configuration of the periphery enables it to laterally surround a periphery of the upper cushioning element and a periphery of a remainder internal mattress assembly.

In another aspect, a mattress cover for a mattress assembly masks, buffers, or dampens the texture or feel of an upper surface of a patterned gel layer of an upper cushioning element of an internal mattress assembly over which the cover is made to be placed. The mattress cover, which may include any of the above-described features in any combination, may have a construction that enables it to permanently enclose or encase the internal mattress assembly or reversibly enclose or encase the internal mattress assembly.

Methods for masking, buffering, or dampening a texture or feel of an upper surface of an upper cushioning element of an internal mattress assembly in which the upper cushioning element comprises a patterned gel layer are also disclosed. Such a method may include positioning a top panel of the mattress cover over an upper surface of the patterned gel layer and positioning a periphery of the mattress cover around a periphery of the internal mattress assembly.

Positioning the top panel of the mattress cover over the upper surface of the patterned gel layer of the upper cushioning element may include orienting an outer fabric layer of the top panel outwardly away from the upper surface of the upper cushioning element. Such an orientation may position a mask layer of the top panel between the outer fabric layer and the upper surface of the patterned gel layer of the upper cushioning element. The top panel, and even its mask layer, may be positioned directly against, or on, the upper surface of the patterned gel layer of the upper cushioning element; thus, the top panel or even its mask layer may contact the upper surface of the patterned gel layer of the upper cushioning element. The top panel of the mattress cover may have a stretchability that enables the mask layer of the top panel to mask, buffer, or dampen the texture or feel of the upper surface of the patterned gel layer of the upper cushioning element without interfering with a compressibility of the upper cushioning element. The mask layer of the top panel of the mattress cover may comprise at least one of a compressible, resilient foam, an elastomeric gel, a stretchable batting, and a ventilating layer.

Positioning of the periphery of the mattress cover around the periphery of the internal mattress assembly may at least partially hold the top panel of the mattress cover in place over the upper surface of the patterned gel layer of the upper cushioning element and secure the mattress cover in place over the internal mattress assembly. In some embodiments, a bottom panel may be positioned beneath the internal mattress assembly and one or more closures may close the mattress cover over the internal mattress assembly to permanently or reversible secure the mattress cover in place over the internal mattress assembly.

Other aspects of the disclosed subject matter, as well as features and advantages of various aspects of the disclosed subject matter, should become apparent to those of ordinary skill in the art through consideration of the preceding description, the accompanying claims, and the appended drawings.

DETAILED DESCRIPTION

Figure 1:
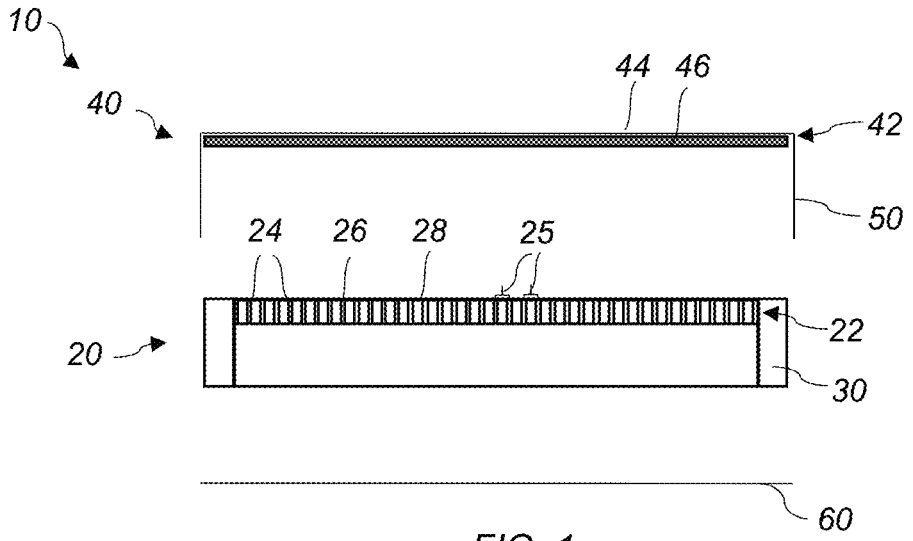
FIG. 1 is a schematic exploded view of an embodiment of a mattress that includes an embodiment of a mattress cover of this disclosure and an internal mattress assembly.
Figure 2:
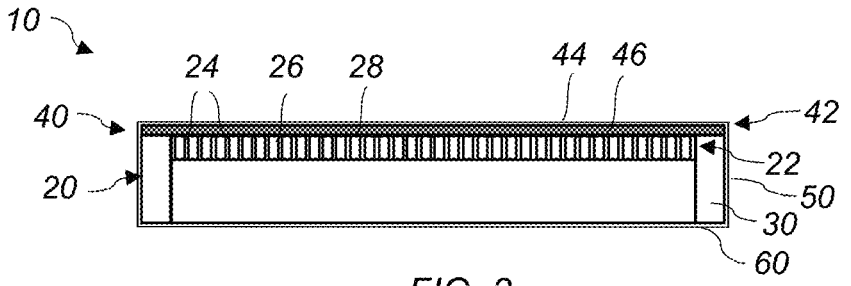
FIG. 2 is a schematic representation of the embodiment of the mattress shown in FIG. 1, with the embodiment of the mattress cover shown in FIG. 1 assembled with the internal mattress assembly.

With reference to FIGS. 1 and 2, an embodiment of a mattress 10 is illustrated. The mattress 10 includes an internal mattress assembly 20 and a mattress cover 40. The mattress cover 40 is positionable over the internal mattress assembly 20.

The internal mattress assembly 20 includes an upper cushioning element 22 that comprises a patterned gel layer. The upper cushioning element 22 may also be referred to as an "upper cushion" and as a "primary cushion" of the mattress 10.

The upper cushioning element 22 may comprise interconnected walls 24 that are formed from a resiliently compressible material and define an array of resiliently buckling columns 25 and a void 26 within each resiliently buckling column 25. Thus, the interconnected walls 24 define a patterned layer. Embodiments of such an upper cushioning element 22 are disclosed by U.S. Pat. Nos. 6,413,458, 7,060,213, 7,076,822, and 8,919,750, the entire disclosures of which are hereby incorporated herein. The interconnected walls 24, resiliently buckling columns 25, and voids 26 may extend completely through a thickness of the upper cushioning element 22, substantially through a thickness of the upper cushioning element 22 (e.g., a film of the material from which the upper cushioning element 22 is formed may extend over a major surface (e.g., an upper surface 28, a bottom surface) of the upper cushioning element 22, etc.), or partially through a thickness of the upper cushioning element 22 (e.g., from one major surface of the upper cushioning element 22 partially into the thickness of the upper cushioning element 22, etc.).

The interconnected walls 24 of the upper cushioning element 22 may be formed from any suitable material, including, but not limited to, an elastomeric material. The elastomeric material may comprise a gel or a gel-like material, or an elastomeric gel or gel elastomer. Examples of elastomeric materials that comprise gel-like materials include, but are not limited to, plasticizer extended block copolymers, di-block copolymers and triblock copolymers. U.S. Pat. Nos. 5,994,450, 6,797,765 and 7,964,664, the entire disclosures of which are hereby incorporated herein, disclose various embodiments of plasticizer extended A-B-A triblock copolymers that may be used to form the upper cushioning element 22. In embodiments where the interconnected walls 24 of the upper cushioning element 22 are formed from a gel or a gel-like material, the upper cushioning element 22 may comprise a patterned gel layer.

A scrim fabric (not shown) may be secured to the bottom surface (not shown) of the upper cushioning element 22. The scrim fabric may comprise fabric that may receive (e.g., engage, be impregnated with, etc.) an adhesive material (e.g., a glue), a material that forms the upper cushioning element 22, or the like. In some embodiments, the scrim fabric may comprise cotton, such as a blend of cotton with a synthetic material (e.g., a cotton spandex blend, etc.). The scrim fabric may be woven or non-woven. In a specific embodiment, the scrim fabric may comprise a 90% cotton/10% spandex blend with a weight of 100 GSM (grams per square meter). The scrim fabric may be secured to the bottom surface of the upper cushioning element 22 by an elastomeric material of the upper cushioning element 22 impregnating the scrim fabric, with an adhesive material, or in any other suitable manner. In embodiments where the mattress 10 includes a cushioning element (e.g., a layer of foam, etc.) (not shown) beneath the upper cushioning element 22, the scrim fabric or elastomeric material that has seeped therethrough may be positioned against the intermediate cushioning element. In some embodiments, the scrim fabric may be secured to the intermediate cushioning element (e.g., with an adhesive material, etc.). In some embodiments, the upper cushioning element 22 may be provided over coils (not shown; see, e.g., U.S. Pat. No. 11,317,733, issued on May 3, 2022, the entire disclosure of which is hereby incorporated herein), over one or more pressurizable chambers (not shown; see e.g., U.S. Patent Application Publication US 2021/0251393 A1, published on Aug. 19, 2021 ("the '393 Publication"), the entire disclosure of which is hereby incorporated herein; U.S. Patent Application Publication US 2022/0273113 A1, published on Sep. 1, 2022, the entire disclosure of which is hereby incorporated herein), or over a combination of coils and one or more pressurizable chambers (see, e.g., the '393 Publication).

An upper surface 28 of the upper cushioning element 22 may define an upper surface of the internal mattress assembly 20. The upper surface 28 of the upper cushioning element 22 is defined by upper surfaces of the interconnected walls 24 that define an array (e.g., a grid array, a staggered array, etc.) of voids 26, or by the patterned layer of the upper cushioning element 22.

Rails 30 (e.g., side rails, end rails, etc.) may be positioned laterally adjacent to side and/or end edges of the internal mattress assembly 20. An upper surface of each rail 30 may be substantially flush with or substantially coplanar with the upper surface 28 of the upper cushioning element 22. Each rail 30 may comprise a compressible, resilient foam material. A stiffness or firmness of the material that forms each rail 30 may exceed a stiffness or firmness of the material that forms the upper cushioning element 22. In some embodiments, the rails 30 may prevent the side edges of the upper cushioning element 22 from bulging outwardly.

The mattress cover 40 of the mattress 10 includes a top panel 42 and a periphery 50. The periphery 50 extends downwardly from outer edges of the top panel 42. Optionally, the mattress cover 40 may also include a bottom 60.

The top panel 42 of the mattress cover 40 includes an outer surface 44 and a mask layer 46. The outer surface 44 may comprise a fabric (e.g., a stretchable fabric, etc.) that forms an upper surface, or a sleep surface, of the mattress 10. The mask layer 46 is located beneath the outer surface 44. The mask layer 46 comprises a material that masks, buffers, or dampens a texture of the upper surface 28 of the upper cushioning element 22. An elasticity of the mask layer 46 may enable it to mask, buffer, or dampen the texture of the upper surface 28 of the upper cushioning element 22 without interfering with a compressibility of the upper cushioning element 22.

The mask layer 46 may have a thickness of about one quarter inch (about 6.35 mm) to about one inch (about 2.5 cm) (e.g., about one half inch (about 13 mm), etc.).

The mask layer 46 may comprise a layer of any of a variety of suitable materials and/or structures, as well as a combination of suitable materials and/or structures. Without limitation, the mask layer 46 may comprise a compressible, resilient foam, a stretchable batting, a patterned layer, a ventilating layer, and/or the like.

Figures 3A, 3B, 3C:
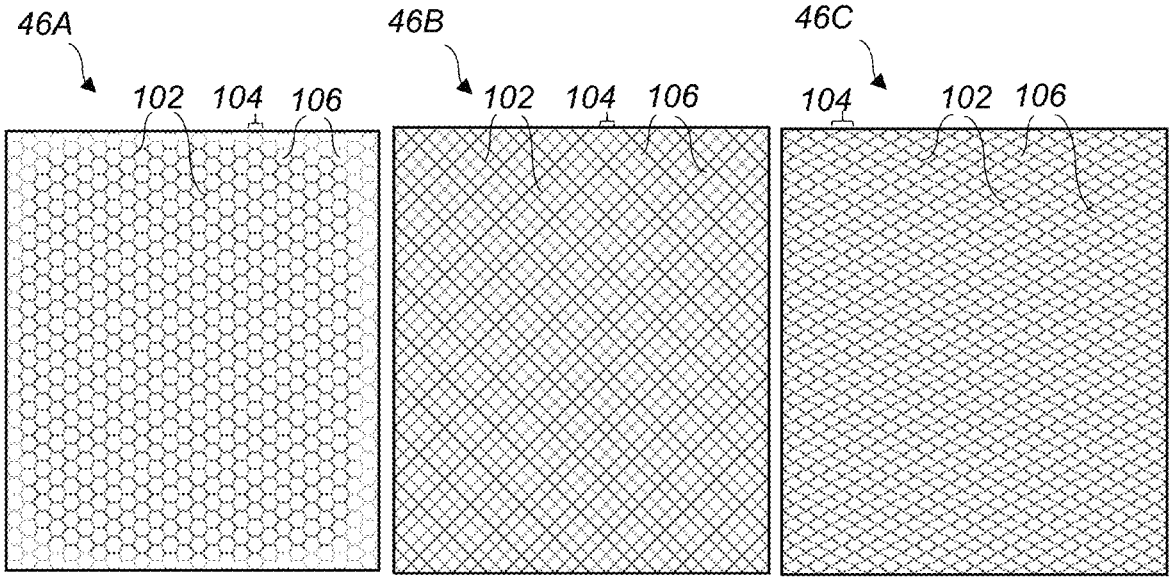
FIGS. 3A, 3B, and 3C are top views of various embodiments of a mask layers that may be included in a mattress cover.

In embodiments where the mask layer 46 comprises a patterned layer, such as the embodiments of mask layers 46A, 46B, and 46C depicted by FIGS. 3A, 3B, and 3C, respectively, the mask layer 46 may be configured as described by U.S. Pat. Nos. 6,413,458, 7,060,213, 7,076,822. Specifically, the mask layer 46 may be defined by a plurality of interconnected walls 102 defining an array of columns 104, each of which includes a void 106 extending therethrough. The interconnected walls 102 may impart the columns 104 with shapes and/or dimensions that differ from shapes and/or dimensions of the buckling columns 25 defined by the interconnected walls 24 of the upper cushioning element 22 of the mattress 10. For example, a maximum dimension across a center of a column 104 of the mask layer 46 may be smaller than a maximum dimension across a center of a buckling column 25 of the upper cushioning element 22.

A mask layer 46 that comprises a patterned layer may be formed from any suitable material. Some examples include foams, memory foams, and gel or gel-like materials. In a specific example, the mask layer 46 or, more specifically, its interconnected walls 102, may be formed from a gel or a gel-like material, or an elastomeric gel or gel elastomer, such as a plasticizer extended block copolymer, di-block copolymer, or triblock copolymer. Examples of plasticizer extended A-B-A triblock copolymers that may be used to form the interconnected walls 102 of the mask layer 46 are described by U.S. Pat. Nos. 5,994,450, 6,797,765 and 7,964,664.

The mask layer 46 may be secured in place relative to the outer surface 44. In some embodiments, the mask layer 46 may be secured to the outer surface 44. The mask layer 46 may be formed separately from the outer surface 44 of the top panel 42 of the mattress cover 40 and then secured (e.g., sewn to (e.g., quilted with, etc.), adhered to, bonded to, etc.) the outer surface 44. Alternatively, in embodiments where the mask layer 46 is formed from an elastomeric material (e.g., a gel or a gel-like material, etc.), it may be formed directly on an underside of the outer surface 44, with the elastomeric material wicking into or impregnating the outer surface 44.

The mask layer 46 may define a bottom surface of the top panel 42 of the mattress cover 40. Thus, when the mattress cover 40 is installed with an internal mattress assembly 20, the mask layer 46 may be positioned directly on the upper surface 28 of the upper cushioning layer 22.

The periphery 50 of the mattress cover 40 extends downwardly from edges of the top panel 42. A configuration of the periphery 50 may enable it to laterally surround a periphery of the internal mattress assembly 20. The periphery 50 may secure the mattress cover 40 in place over the internal mattress assembly 20.

In embodiments where the mattress cover 40 includes a bottom 60, the bottom 60 may further secure the mattress cover 40 in place over the internal mattress assembly 20. Edges of the bottom 60 may be secured to bottom edges of the periphery 50 in any suitable manner (e.g., by sewing, with one or more zippers, etc.) to enclose or encase the internal mattress assembly 20 within the mattress cover 40.

Figure 4:
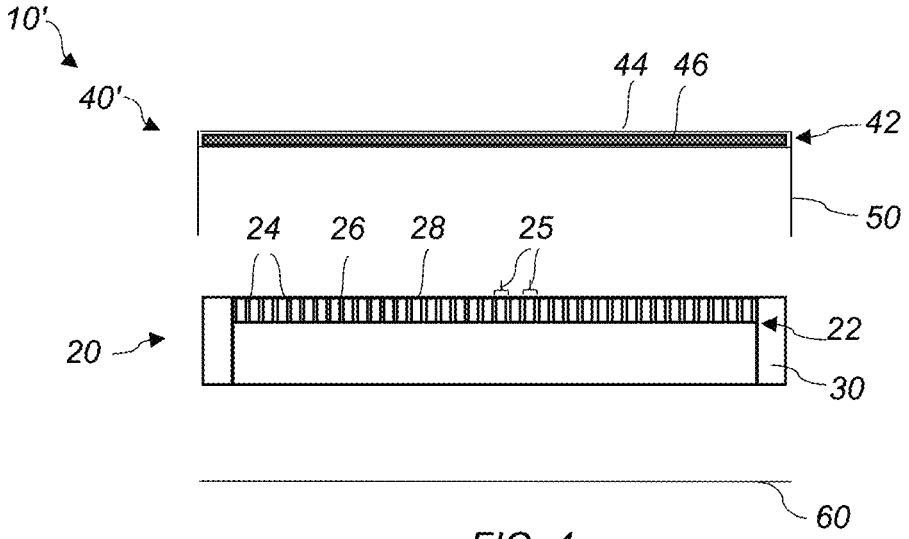
FIG. 4 is a schematic exploded view of an embodiment of a mattress that includes another embodiment of a mattress cover of this disclosure and an internal mattress assembly.
Figure 5:
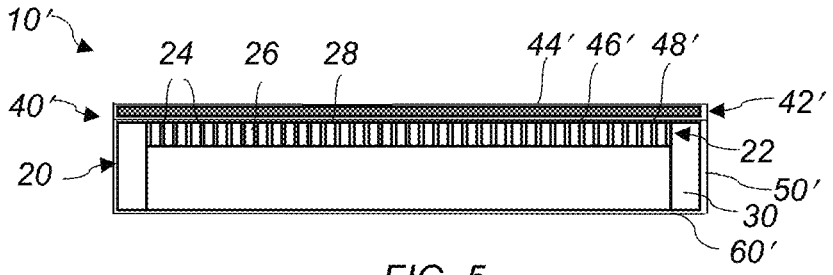
FIG. 5 is a schematic representation of the embodiment of the mattress shown in FIG. 4, with the embodiment of the mattress cover shown in FIG. 4 assembled with the internal mattress assembly.

Turning now to FIGS. 4 and 5, another embodiment of a mattress 10' is illustrated. The mattress 10' includes an internal mattress assembly 20 and a mattress cover 40'.

The internal mattress assembly 20 may include the same features as the internal mattress assembly 20 of the embodiment of mattress 10 depicted by FIGS. 1 and 2, including but not limited to an upper cushioning element 22 that comprises a patterned gel layer. The upper cushioning element 22 may also be referred to as an "upper cushion" and as a "primary cushion" of the mattress 10'.

The mattress assembly 10 also includes a mattress cover 40'. The mattress cover 40' includes a top panel 42' and a periphery 50'. Optionally, the mattress cover 40' may also include a bottom 60'.

The top panel 42 of the mattress cover 40 includes an outer surface 44 and a mask layer 46. The outer surface 44 may comprise a fabric (e.g., a stretchable fabric, etc.) that forms an upper surface, or a sleep surface, of the mattress 10. The mask layer 46 is located beneath the outer surface 44. The mask layer 46 comprises a material that masks, buffers, or dampens a texture of the upper surface 28 of the upper cushioning element 22. An elasticity of the mask layer 46 may enable it to mask, buffer, or dampen the texture of the upper surface 28 of the upper cushioning element 22 without interfering with a compressibility of the upper cushioning element 22.

The top panel 42' of the mattress cover 40' includes an outer surface 44', a mask layer 46', and a lower layer 48'. The outer surface 44' may comprise a fabric (e.g., a stretchable fabric, etc.) that forms an upper surface, or a sleep surface, of the mattress 10'. The mask layer 46' is located beneath the outer surface 44'. The mask layer 46' comprises a material that masks, buffers, or dampens a texture of the upper surface 28 of the upper cushioning element 22. The mask layer 46' may include any features described previously herein in reference to the mask layer 46 of the embodiment of mattress cover 40 shown in FIGS. 1 and 2. An elasticity of the mask layer 46' may enable it to mask, buffer, or dampen the texture of the upper surface 28 of the upper cushioning element 22 without interfering with a compressibility of the upper cushioning element 22. The lower layer 48' is located beneath the mask layer 46'.

The mask layer 46' may be secured in place relative to one or both of the outer surface 44' and the lower layer 48' of the mattress cover 40'. In some embodiments, the mask layer 46' may be formed separately from the outer surface 44' and the lower layer 48' of the top panel 42' of the mattress cover 40' and then secured (e.g., sewn to (e.g., quilted with, etc.), adhered to, bonded to, etc.) one or both of the outer surface 44' and the lower layer 48'. Alternatively, in embodiments where the mask layer 46' is formed from an elastomeric material (e.g., a gel or a gel-like material, etc.), it may be formed directly on an underside of the outer surface 44' or a topside of the lower layer 48', with the elastomeric material wicking into or impregnating the outer surface 44' or the lower layer 48'.

The lower layer 48' may define a bottom surface of the top panel 42' of the mattress cover 40'. Thus, when the mattress cover 40' is installed with an internal mattress assembly 20, the lower layer 48' may be positioned directly on the upper surface 28 of the upper cushioning layer 22.

The periphery 50' of the mattress cover 40' extends downwardly from edges of the top panel 42'. A configuration of the periphery 50' may enable it to laterally surround a periphery of the internal mattress assembly 20. The periphery 50' may secure the mattress cover 40' in place over the internal mattress assembly 20.

In embodiments where the mattress cover 40' includes a bottom 60', the bottom 60' may further secure the mattress cover 40' in place over the internal mattress assembly 20. Edges of the bottom 60' may be secured to bottom edges of the periphery 50' in any suitable manner (e.g., by sewing, with one or more zippers, etc.) to enclose or encase the internal mattress assembly 20 within the mattress cover 40'.

Although this disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A mattress, comprising:

an internal mattress assembly including:

an upper cushioning element comprising a plurality of interconnected walls defined from an elastomeric gel and defining an array of cells, the interconnected walls and the array of cells defining a patterned gel layer; and a mattress cover including:

a top panel over an upper surface of the upper cushioning element comprising:

an outer surface formed from a fabric;

a mask layer secured in place beneath the outer surface and comprising an elastomeric gel material defining a plurality of walls defining a patterned gel layer that is different than the patterned gel layer of the upper cushioning element and that masks a texture of an upper surface of the patterned gel layer; and a lower surface formed from the fabric; and a periphery extending downwardly from edges of the top panel and laterally surrounding a periphery of the upper cushioning element and a periphery of a remainder of the internal mattress assembly, wherein the mattress cover is removably coupled with the upper cushioning element such that the top panel of the mattress cover removably couples with the upper surface of the upper cushioning element and the periphery of the mattress cover removably couples with the periphery of the upper cushioning element.

2. The mattress of claim 1, wherein the lower surface is positioned beneath the mask layer.

3. The mattress of claim 1, wherein a stretchability of the top panel of the mattress cover enables the mask layer of the top panel to mask the texture of the upper cushioning element without interfering with a compressibility of the upper cushioning element.

4. The mattress of claim 1, wherein the mask layer of the top panel of the mattress cover has a thickness of approximately one quarter inch to approximately one inch.

5. The mattress of claim 4, wherein the mask layer of the top panel of the mattress cover has a thickness of approximately one half inch.

6. The mattress of claim 1, wherein the plurality of walls of the mask layer are compressible and resilient.

7. The mattress of claim 1, wherein the plurality of walls of the mask layer are a plurality of interconnected walls defining an array of cells, wherein the cells of the array of cells have shapes and/or dimensions that differ from shapes and/or dimensions of cells of the array of cells of the upper cushioning element of the mattress assembly.

8. The mattress of claim 7, wherein a maximum dimension across a center of a cell of the array of cells of the mask layer of the top panel of the mattress cover is smaller than a maximum dimension across a center of a cell of the array of cells of the upper cushioning element of the mattress.

9. The mattress of claim 1, wherein the mask layer of the top panel of the mattress cover comprises a stretchable batting.

10. The mattress of claim 1, wherein the mask layer comprises the elastomeric gel material defining the plurality of walls formed on a side of the outer surface.

11. A mattress cover, comprising:

a top panel positionable over an upper surface of an internal mattress that includes an upper cushioning element comprising an elastomeric gel defining a plurality of interconnected walls defining an array of cells, the interconnected walls and the array of cells defining a patterned gel layer, the top panel comprising:

an outer surface formed from a fabric;

a mask layer secured in place beneath the outer surface and comprising an elastomeric gel material defining a plurality of walls defining a patterned gel layer that is different than the patterned gel layer of the upper cushioning element and that masks a texture of an upper surface of the patterned gel layer; and a lower surface formed from the fabric; and a periphery extending downwardly from edges of the top panel and laterally surrounding a periphery of the internal mattress assembly, wherein the top panel removably couples with the upper surface of the upper cushioning element and the periphery of the mattress cover removably couples with the periphery of the upper cushioning element.

12. The mattress cover of claim 11, wherein the lower surface is positioned beneath the mask layer.

13. The mattress cover of claim 11, wherein the mask layer of the top panel of the mattress cover has a thickness of approximately one quarter inch to approximately one inch.

14. The mattress cover of claim 13, wherein the mask layer of the top panel of the mattress cover has a thickness of approximately one half inch.

15. The mattress cover of claim 11, wherein the plurality of walls of the mask layer are compressible and resilient.

16. The mattress cover of claim 11, wherein the plurality of walls of the mask layer are a plurality of interconnected walls defining an array of cells.

17. The mattress cover of claim 11, wherein the mask layer of the top panel of the mattress cover comprises a stretchable batting.

18. A method for masking a texture of an upper surface of an internal mattress that includes an upper cushioning element comprising an elastomeric gel defining a plurality of interconnected walls defining an array of cells, the interconnected walls and the array of cells defining a patterned gel layer, the method comprising:

placing a mattress cover over the internal mattress, including:

positioning a top panel of the mattress cover over an upper surface of the patterned gel layer, including orienting an outer fabric layer of the top panel outwardly away from the upper surface and orienting a lower fabric layer of the top panel toward the upper surface such that a mask layer of the top panel, comprising an elastomeric gel material defining a plurality of walls defining a patterned gel layer that is different than the patterned gel layer of the upper cushioning element, is disposed between the outer fabric layer and the upper surface of the patterned gel layer; and positioning a periphery of the mattress cover around a periphery of the internal mattress assembly, wherein the mattress cover is removably placed over the internal mattress such that the top panel of the mattress cover removably couples with the upper surface of the upper cushioning element and the periphery of the mattress cover removably couples with the periphery of the upper cushioning element.

19. The method of claim 18, wherein positioning the top panel of the mattress cover comprises positioning a top panel with a stretchability that enables the mask layer of the top panel to mask the texture of the upper cushioning element without interfering with a compressibility of the upper cushioning element.

20. The method of claim 19, wherein positioning the top panel of the mattress cover comprises positioning a top panel with a mask layer comprising the plurality of walls defining an array of cells over the upper surface of the patterned gel layer.

21. The method of claim 18, wherein positioning the top panel of the mattress cover comprises placing the top panel of the mattress cover directly against the upper surface of the patterned gel layer.

* * * * *